United States Patent [19]

Connell

[11] 4,139,966

[45] Feb. 20, 1979

[54] TRICK ROPE DEVICE

[76] Inventor: John Connell, 44 Charles St. W., Apt. 704, Toronto, Ontario, Canada

[21] Appl. No.: 780,037

[22] Filed: Mar. 22, 1977

[51] Int. Cl.[2] ..... A63H 33/00

[52] U.S. Cl. ..... 46/1 G; 46/228; 46/51

[58] Field of Search ..... 46/1G, 49, 51, 52, 228, 46/226, 47

[56] References Cited

U.S. PATENT DOCUMENTS

| | | | |
|---|---|---|---|
| 1,915,868 | 6/1933 | Rogers | 46/51 |
| 1,953,565 | 4/1934 | O'Neil | 46/1 G |
| 2,044,240 | 6/1936 | Daniels | 46/1 G |
| 2,071,041 | 2/1937 | Maggio | 46/1 G |
| 2,947,108 | 8/1960 | Dodd, Jr. et al. | 46/51 X |
| 2,968,117 | 1/1961 | Trombly | 46/1 G |
| 3,325,940 | 6/1967 | Davis | 46/52 X |
| 3,707,055 | 12/1972 | Pearce | 46/228 |

FOREIGN PATENT DOCUMENTS

| | | | |
|---|---|---|---|
| 504033 | 4/1939 | United Kingdom | 46/1 G |

*Primary Examiner*—Russell R. Kinsey
*Assistant Examiner*—Mickey Yu
*Attorney, Agent, or Firm*—Rogers, Bereskin & Parr

[57] ABSTRACT

A trick rope device for forming a noose in a horizontal plane includes a rope member having one end formed into a noose. The other end of the rope is swiveling joined to a handle portion. A mechanism is provided for controlling the speed of rotation of the rope member. A flashing light unit is disposed within the handle portion, wherein the flashing of the light unit is directly dependable upon the speed of rotation of the rope member.

8 Claims, 4 Drawing Figures

TRICK ROPE DEVICE

BACKGROUND OF THE INVENTION

A number of U.S. Patents relate to trick rope devices. These U.S. Pat. Nos. are: 1,953,565 to O'Neil; 2,039,731 to Martin; 2,071,041 to Maggio; and 2,968,117 to Trombly. These aforementioned patents are non-applicable to my present invention.

SUMMARY OF THE INVENTION

My present invention relates to a unique and novel trick rope device used to form a perfect horizontal noose.

An object of my present invention is to provide a trick rope device, wherein the user can form a perfect horizontal spinning noose without having to use unnecessary movement of the hand.

A further object of my present invention is to provide a whistle means disposed on the noose.

A further object of my present invention is to provide a flashing light unit disposed in the handle portion of the device, wherein the activation of the light is dependent upon the spinning of the rope member.

A further object of my present invention is to allow selective lengthening and shortening of the length of the rope as well as the size of the noose by moving the two sections of the handle together or away from each other.

Briefly, my present invention comprises an elongated rope member having a noose formed at one end thereof. The other end of the rope member is swivelably joined to a handle member. A flashing light unit is disposed in the handle member. A whistle member is disposed on the elongated rope member.

BRIEF DESCRIPTION OF THE DRAWINGS

The objects and features of the invention may be understood with reference to the following detailed description of an illustrative embodiment of the invention, taken together with the accompanying drawings in which.

DETAILED DESCRIPTION OF THE PREFERRED EMBODIMENT

Figure 1:
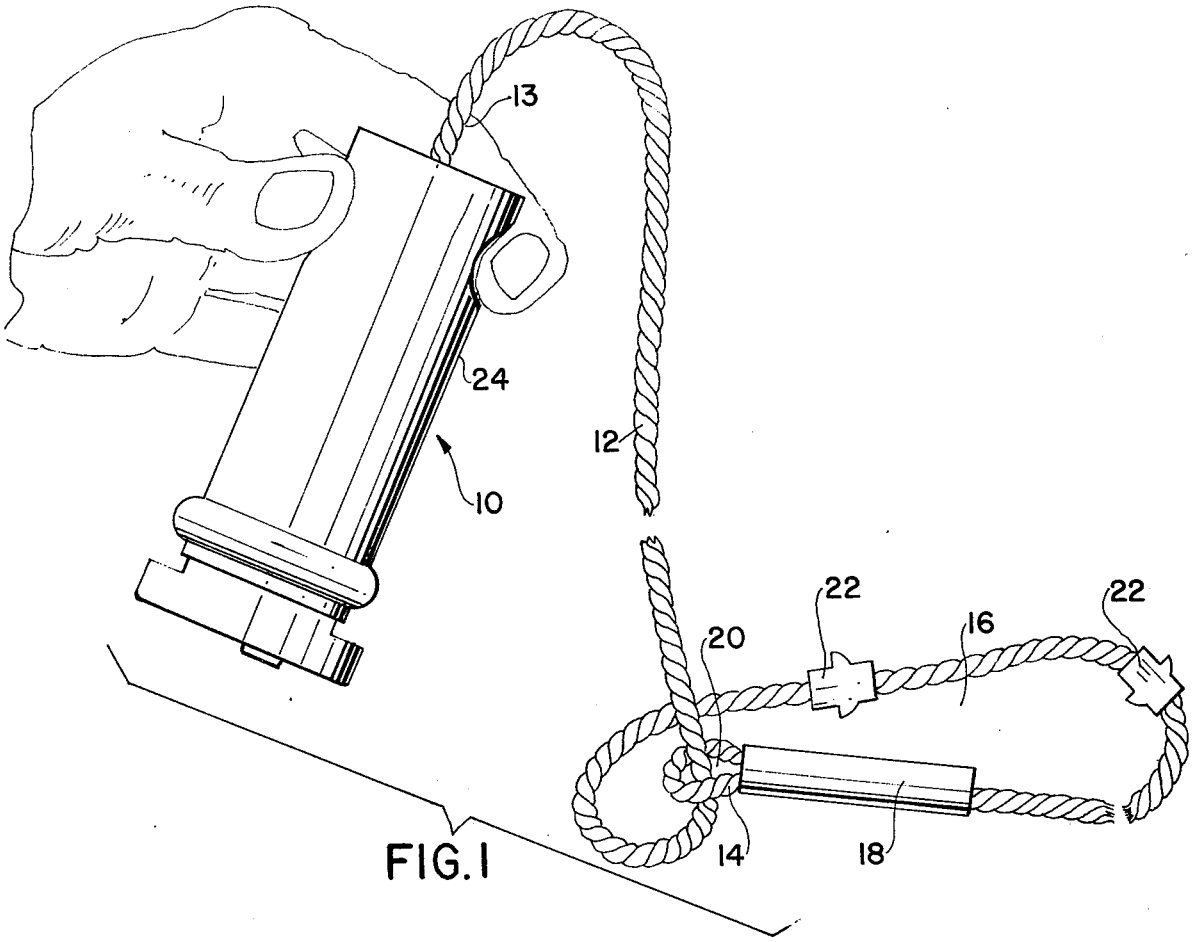
FIG. 1 illustrates a perspective view of a trick rope device.
Figure 2:
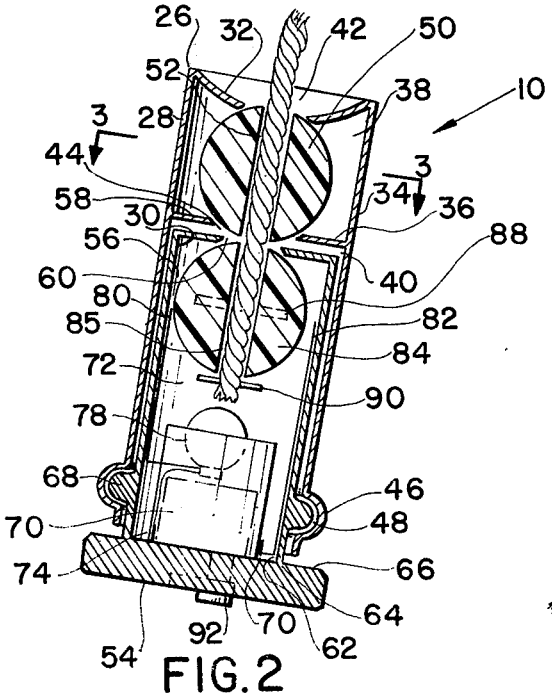
FIG. 2 illustrates a cross-sectional view of a handle portion of the device.
Figure 3:
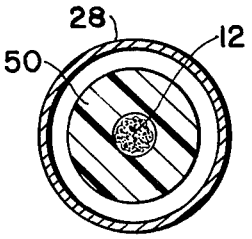
FIG. 3 illustrates a top cross-sectional view of the handle portion taken along lines 3—3 of FIG. 2.
Figure 4:
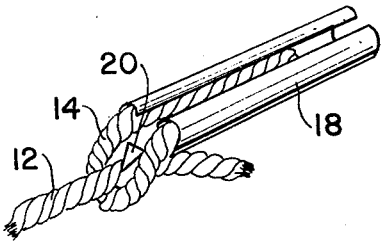
FIG. 4 illustrates a perspective view of a clamp means for forming a noose of the device.

Turning now descriptively to the drawings, in which similar reference characters denote similar elements throughout the several views, FIGS. 1-2 show a trick rope device 10 used by a person to spin a rope to form a perfect noose. The device 10 generally comprises an elongated rope member 12 having one end 14 formed into the shape of a noose 16. The one end 14 of the rope member 12 is bent backward upon itself held by a clamp means 18 as depicted in FIG. 4 thereby forming a loop 20. The one end 14 is passed through loop 20 to form the noose portion 16 of the rope member 12. A plurality of whistle members 22 are disposed on the noose portion 16 of the rope member 12, wherein the whistle members 22 are activated, when the noose portion 16 begins to spin. The other end 15 of the rope member 12 is swivelingly joined to a handle portion 24. The handle portion 24 comprises a two sectional housing 26 having an upper 28 and a lower 30 portion. The upper portion 28, a concave top 32 and a downwardly extending cylindrically shaped wall 34 and an intermediate wall 36 aligned in parallel relationship to top 32 thereby forming an upper 38 and a lower 40 compartment therein. The top 32 has an enlarged center opening 42 therein and wall 36 has an enlarged center hole 44 therein. The wall 36 has a first outer annular bead 46 disposed thereon at a lower end thereof, wherein the inner surface of wall 36 has an annular groove 48 therein which is aligned with bead 46 and extends outwardly into the bead 46. A first ball member 50 is disposed for rotation within the upper compartment 38, wherein ball 50 rotates into opening 42 and hole 44. The ball 50 has a central bore 52 therethrough, wherein the end 15 of the rope member 12 extends through bore 52. The bore 52 is of a diameter such that the rope member 12 is frictionally engaged within the bore 52. The lower portion 30 of housing 26 comprises a base 54, an upwardly extending cylindrically shaped sidewall 56, and a top 58 with a center aperture 60 therethrough. A lower end 62 of wall 56 threadably engages into an annularly shaped threaded groove 64 in an upper surface 66 of the base 54. A second annular bead 68 is disposed on the outer surface of wall 56, wherein bead 68 snaps into groove 48 when the upper portion 28 is disposed onto the lower portion 30 of the housing 26. The walls 34, 56 of the upper 28 and lower 30 portions, respectively, of housing 26 are formed from clear, transparent, flexible plastic which can be readily deformed inwardly upon pressure exerted by the user's fingers. The plastic can be selected from the group consisting of polyethylene, polypropylene, ethylene vinyl acetate, or polyvinyl chloride. A battery means 70 is disposed within the compartment 72 of the lower portion 30, wherein the battery means 70 is disposed between two electrical contact points 74, 76. One contact point 74 is wired to a light means 78. A first electrical conductive strip 80 is disposed on the inner surface of wall 56 and is wired to the light means 78. A second electrical conductive strip 82 is wired to the contact point 76. A second ball member 84 has a bore 86 therethrough, wherein the first 50 and second 84 ball members are formed from non-conductive plastic such as teflon. A three quarter annular conductive metallic band 88 is embedded in the outer surface of ball member 84. The ball member 84 is disposed for rotation within compartment 72 wherein the end 15 of the rope member 12 is press fitted through the bore 86 of the ball member 84. A clamp member 90 is affixed to the one end 14 of the rope member 12 which extends through the ball member 84. An on/off electric switch 92 is disposed in the base 54 of the lower portion 30. The series circuit consists essentially of the battery means 70, on/off switch 92, light means 78 and the ball member 84 with band 88 acting as an intermittent switching means between the strips 80, 82.

In use, the person holds the device by the handle portion 24 and spins the rope member 12 causing the noose to form in a horizontal plane.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A trick rope device for forming a noose in a horizontal plane, which comprises:

an elongated rope member, means for forming one end of said rope member for forming said noose of said rope member, a handle portion having an upper and a lower housing portion, said housing portions removably secured together, a first ball member, said first ball member disposed for rotation in said upper housing said ball member receiving another end of said rope member therethrough; and a second ball member, said second ball member disposed for rotation in said lower housing portion, said ball member receiving said another end of said rope member therethrough.

2. A device according to claim 1, wherein said noose forming means further comprises said one end of said rope member formed in a loop, a clamp means for maintaining said loop, and said other end of said rope member extending through said loop.

3. A device according to claim 1, wherein said handle further comprises:

said lower housing portion having a base, an upwardly extending cylindrically shaped side wall, and a top, said top of said lower housing portion receiving said rope member therethrough; and said upper housing portion having a concave top with an aperture therethrough, and a downwardly extending sidewall, said sidewall of said upper housing portion fitting over said side wall of said lower housing portion.

4. A device according to claim 3, wherein said walls of said upper housing portion and said lower housing portion are a transparent deformable plastic for permitting pressure to be exerted on said ball members to control the speed of rotation of said ball members.

5. A device according to claim 1, further comprising a clamp element disposed on said another end of said rope member below said second ball member.

6. A device according to claim 4, further comprising:

a light means disposed in said lower housing portion, a battery means disposed in said lower housing portion an intermittent electric switching means disposed in said lower housing portion, said switching means wired in a series circuit to said light means and said battery means.

7. A device according to claim 6, further including an on/off electrical switch in said series circuit.

8. A device according to claim 6, wherein said intermittant switching means further comprises:

first and second electrical conductive strips disposed on an inner surface of said sidewall of said lower housing portion, said first strip wired to said battery means, said second strip wired to said light means; and a plurality of half annularly shaped metallic bands embedded in said second ball member of non-conductive material, said annular shaped metallic band making intermittant electric contact simultaneously with said two strips thereby causing said light means to flash.

* * * * *